US007412833B2

(12) United States Patent
Widener

(10) Patent No.: US 7,412,833 B2
(45) Date of Patent: Aug. 19, 2008

(54) METHOD OF COOLING CENTERBODY OF PREMIXING BURNER

(75) Inventor: Stanley Kevin Widener, Greenville, SC (US)

(73) Assignee: General Electric Company, Schenectady, NY (US)

( * ) Notice: Subject to any disclaimer, the term of this patent is extended or adjusted under 35 U.S.C. 154(b) by 438 days.

(21) Appl. No.: 11/206,029

(22) Filed: Aug. 18, 2005

(65) Prior Publication Data

US 2006/0010878 A1 Jan. 19, 2006

Related U.S. Application Data

(62) Division of application No. 10/859,232, filed on Jun. 3, 2004, now Pat. No. 7,007,477.

(51) Int. Cl.
*F02C 7/22* (2006.01)
*F23R 3/14* (2006.01)

(52) U.S. Cl. ..... 60/772; 60/737; 60/748; 431/2; 239/132.5

(58) Field of Classification Search ..... 60/772, 60/740, 737, 746, 747, 748, 39.83; 431/2, 431/354; 239/132–132.5
See application file for complete search history.

(56) References Cited

U.S. PATENT DOCUMENTS 3,045,997 A * 7/1962 Hudson ..... 239/132.3
5,077,967 A 1/1992 Widener et al.
5,101,633 A 4/1992 Keller et al.
5,154,060 A 10/1992 Walker et al.
5,199,265 A 4/1993 Borkowicz
5,211,004 A 5/1993 Black
5,220,795 A 6/1993 Dodds et al.
5,487,275 A 1/1996 Borkowicz et al.
5,575,146 A 11/1996 Borkowicz et al.
5,924,275 A 7/1999 Cohen et al.
6,019,596 A * 2/2000 Knopfel et al. ..... 60/737
6,363,724 B1 4/2002 Bechtel et al.
6,438,961 B2 8/2002 Tuthill et al.
6,453,673 B1 9/2002 Bechtel et al.
6,460,326 B2 10/2002 Bechtel et al.
6,981,358 B2 * 1/2006 Bellucci et al. ..... 60/737

FOREIGN PATENT DOCUMENTS

JP 61-083813 * 4/1986
JP 08-233271 * 9/1996

* cited by examiner

*Primary Examiner*—Ted Kim
(74) *Attorney, Agent, or Firm*—Nixon & Vanderhye PC

(57) ABSTRACT

A gas-air premixing burner for gas turbines includes an air swirler and an annular burner tube surrounding a bluff centerbody. The bluff body serves to stabilize the flame by defining a recirculating vortex. Cooling air is directed to impinge against the bluff face of the centerbody and the spent impingement cooling air flows in a reverse direction towards the air swirler within the centerbody and is discharged through holes at the outer diameter of the centerbody, where it mixes with the fuel/air mixture prior to reaching the flame zone.

6 Claims, 3 Drawing Sheets

METHOD OF COOLING CENTERBODY OF PREMIXING BURNER

RELATED APPLICATION

This application is a division of application Ser. No. 10/859,232, filed Jun. 3, 2004, now U.S. Pat. No. 7,007,477 the entire disclosure of which is incorporated herein by this reference.

BACKGROUND OF THE INVENTION

The invention relates to a fuel nozzle such as a gas-air premixing burner for use in gas turbines, comprising an air swirler and annular burner tube surrounding a bluff centerbody. More particularly, the invention relates to a nozzle end configuration and to an adaptation for cooling the same.

Gas turbines for power generation are generally available with fuel nozzles configured for either "Dual Fuel" or "Gas Only". "Gas Only" refers to operation burning, for example, natural gas and "Dual Fuel" refers to having the capability of operation burning either natural gas or liquid fuel. The "Dual Fuel" configuration is generally applied with oil used as a backup fuel, if natural gas is unavailable. The "Gas Only" configuration is offered in order to reduce costs as the nozzle parts and all associated equipment required for liquid fuel operation are not supplied. In general, fuel nozzles are designed to have "Dual Fuel" capability and the "Gas Only" version is a modification to the dual fuel design in which the liquid fuel parts, which include the oil, atomizing air and diluent water passages, are omitted from the nozzle and replaced with a component of similar size and shape, but without the internal features of the liquid fuel cartridge. This replacement component is known as a "Gas-Only Insert." An example of a fuel nozzle configured for gas-only operation is illustrated in FIG. 1.

FIG. 1 is a cross-section through the burner assembly 10. The burner assembly is divided into four regions by function including an inlet flow conditioner 12, an air swirler assembly with natural gas fuel injection (referred to as a swozzle assembly) 14, an annular fuel/air mixing passage 16, and a central diffusion flame fuel nozzle assembly 18.

Air enters the burner from a high pressure plenum, which surrounds the assembly, except the discharge end which enters the combustor reaction zone. Most of the air for combustion enters the premixer via the inlet flow conditioner 12. The inlet flow conditioner includes an annular flow passage that is bounded by a solid cylindrical inner wall 20 at the inside diameter, a perforated cylindrical outer wall 22 at the outside diameter, and a perforated end cap 24 at the upstream end. In the center of the flow passage are one or more annular turning vanes 26. Premixer air enters the inlet flow conditioner 12 via the perforations in the end cap 24 and in the cylindrical outer wall 22.

After combustion air exits the inlet flow conditioner 12, it enters the swozzle assembly 14. The swozzle assembly includes a hub 28 and a shroud 30 connected by a series of air foil shaped turning vanes 32, which impart swirl to the combustion air passing through the premixer. Each turning vane 32 contains natural gas fuel supply passage(s) through the core of the air foil. These fuel passages distribute natural gas fuel to gas fuel injection holes 34 which penetrate the wall of the air foil. The fuel injection holes may be located on the pressure side, the suction side, or both sides of the turning vanes 32. Natural gas fuel enters the swozzle assembly 14 through inlet port(s) and annular passage(s) 36, which feed the turning vane passages. The natural gas fuel begins mixing with combustion air in the swozzle assembly, and fuel/air mixing is completed in the annular passage 16, which is formed by a centerbody extension 38 and a burner tube extension 40. After exiting the annular passage 16, the fuel/air mixture enters the combustor reaction zone where combustion takes place.

At the center of the burner assembly is a diffusion flame fuel nozzle assembly 18, which receives natural gas fuel through annular passage 42 and holes 44. In the center of this diffusion flame fuel nozzle is a cavity 46, which, as noted above, receives either the liquid fuel assembly to provide dual fuel capability or the gas-only insert. The gas-only insert 45 is shown in this example. In the dual fuel configuration, during gas fuel operation, the oil, atomizing air and water passages in this region are purged with cool air to block hot gas from entering the passages when not in use. When the nozzle is configured for gas only operation, cavity 46 must be substantially capped, as shown, at the distal end of the nozzle, to block hot combustion gas from entering the center region 46, which may result in mechanical damage due to the high temperature. A small amount of air passes through holes 47 in the end of the gas-only insert to cool and purge the tip of the gas-only insert.

Currently, the centerbody is cooled with air discharged directly into the recirculation zone 57 through orifices or passages 48 at the bluff face 63 of the centerbody. This air is sometimes referred to as curtain air. As schematically illustrated in FIG. 1, the curtain air stream 50 for cooling the centerbody conventionally feeds through a passage defined therefor in the swirler vanes 32, through annular passage 52 and, as mentioned above, exits through orifices or passages 48 at the end of the centerbody. However, this air does not have time to mix thoroughly before it reaches the flame.

Some fuel nozzle designs do not have a separate cooling air passage for the tip of the centerbody. These designs rely for cooling on air used to purge the diffusion fuel passages when fuel is not supplied to the diffusion fuel passages. In these designs, there is a risk of thermal distress during the transient transition between diffusion fuel flow and purge air flow.

BRIEF DESCRIPTION OF THE INVENTION

Dynamics must be controlled by careful optimization of the quantity of air used for cooling and purge. Flame stability and lean blow out are influenced and limited by the air used for cooling and purge. $NO_x$ emissions are also affected by the effectiveness of mixing of the cooling and purge air prior to the flame.

Conventional premixing burners as described above may suffer from dynamics sensitivity and lean stability degradation by the discharge of fuel nozzle and centerbody cooling and purge air directly into the recirculation zone behind the bluff body. This air both dilutes the mixture in the recirculation zone and leads to unstable combustion due to reduction of the flame temperature and unstable feed back to the pressure ratio across the discharge orifice.

In an embodiment of the invention, impingement cooling technology is applied to a premixing burner to cool the face of the bluff centerbody that is exposed to high-temperature flame at the aft end. Thus, the invention reduces the quantity of air injected into the recirculation zone relative to conventional practice, thereby improving flame stability and dynamic sensitivity to pressure fluctuations. The invention may be applied in conjunction with gas-only or dual fuel nozzle designs.

Thus, the invention may be embodied in a fuel nozzle comprising: an outer peripheral wall; a nozzle centerbody concentrically disposed within said outer wall; a fuel/air premixer including an air inlet, a fuel inlet, and a premixing passage defined between said outer wall and said centerbody and extending at least part circumferentially thereof; a cooling air flow passage defined within said centerbody and extending at least part circumferentially thereof; a gas fuel flow passage defined within said centerbody and extending at least part circumferentially thereof; said cooling air flow air passage comprising a first passage and a second passage, said first passage terminating axially at a perforated impingement plate structure defining orifices for impingement flow of said cooling air toward and against an inner surface of an end face of the centerbody, and said second passage extending from a vicinity of said impingement plate structure and said inner surface to at least one orifice defined in an outer wall of said centerbody and in flow communication with said premixing passage defined between said nozzle centerbody and said outer wall of said centerbody.

The invention may also be embodied in a method of cooling a fuel nozzle that includes an outer peripheral wall, a nozzle centerbody concentrically disposed within said outer wall, a fuel/air premixer including an air inlet, a fuel inlet, and a premixing passage defined between said outer wall and said centerbody and extending at least part circumferentially thereof; a cooling air flow passage defined within said centerbody and extending at least part circumferentially thereof; and a gas fuel flow passage defined within said centerbody and extending at least part circumferentially thereof; the method comprising: flowing cooling air through said cooling air toward and impinging said cooling air against an inner surface of an end face of the centerbody; and flowing spent impingement air from a vicinity of said inner surface to and into said premixing passage defined between said nozzle centerbody and said outer wall of said centerbody.

BRIEF DESCRIPTION OF THE DRAWINGS

These and other objects and advantages of this invention, will be more completely understood and appreciated by careful study of the following more detailed description of the presently preferred exemplary embodiments of the invention taken in conjunction with the accompanying drawings, in which.

DETAILED DESCRIPTION OF THE INVENTION

Figure 1:
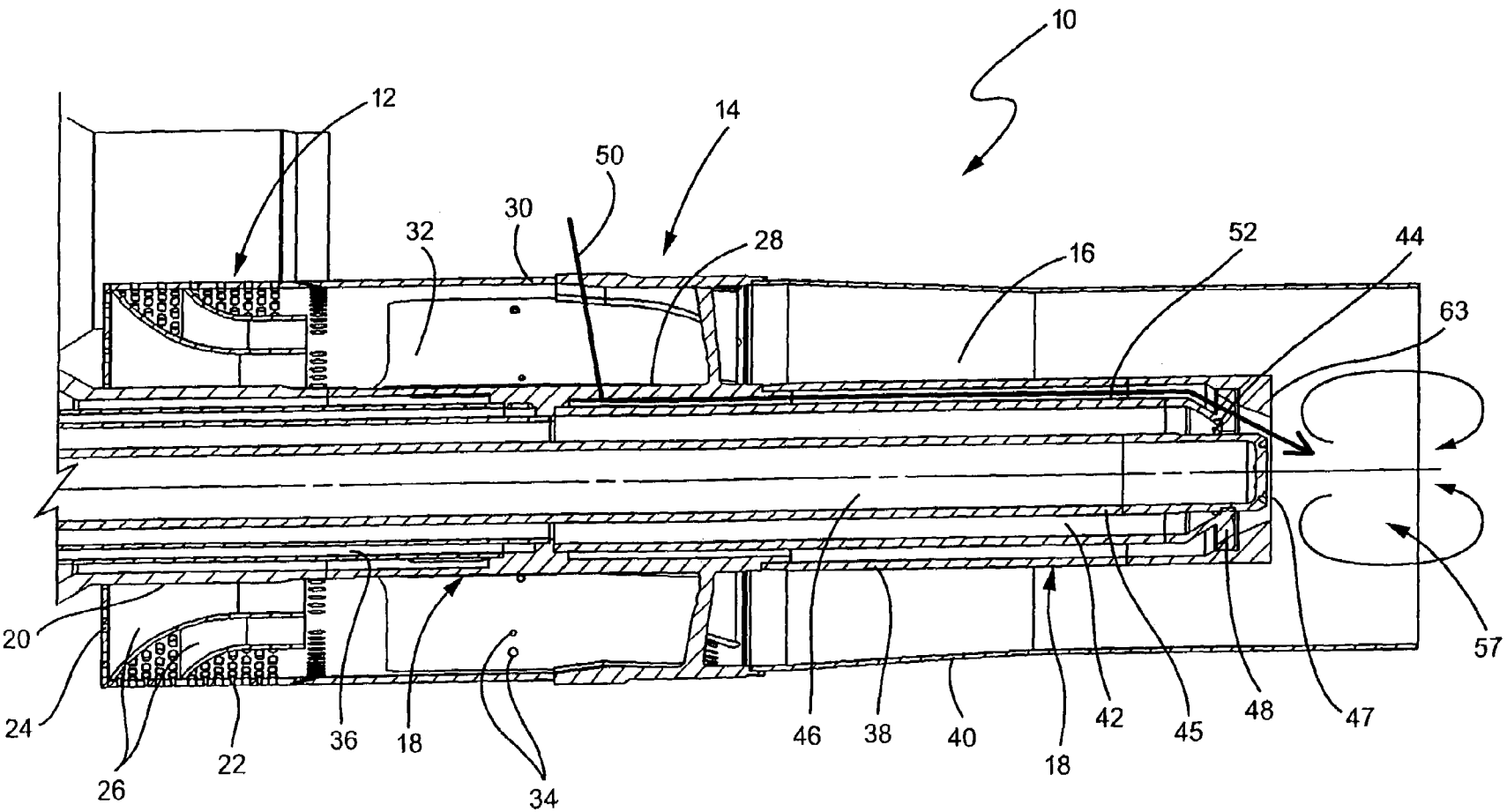
Fig. 1 (Prior Art)
FIG. 1 is a schematic view, partly in cross-section, of a burner schematically illustrating a flow path of curtain air for cooling the centerbody.

Conventional premixing burners of the type illustrated in FIG. 1 may suffer from dynamic sensitivity and lean stability degradation by the discharge of fuel nozzle and centerbody cooling and purge air directly in the recirculation zone behind the bluff body. This air both dilutes the mixture in the recirculation zone and leads to unstable combustion due to reduction of the fine temperature and unstable feedback to the pressure ratio across the discharge orifice.

Figure 2:
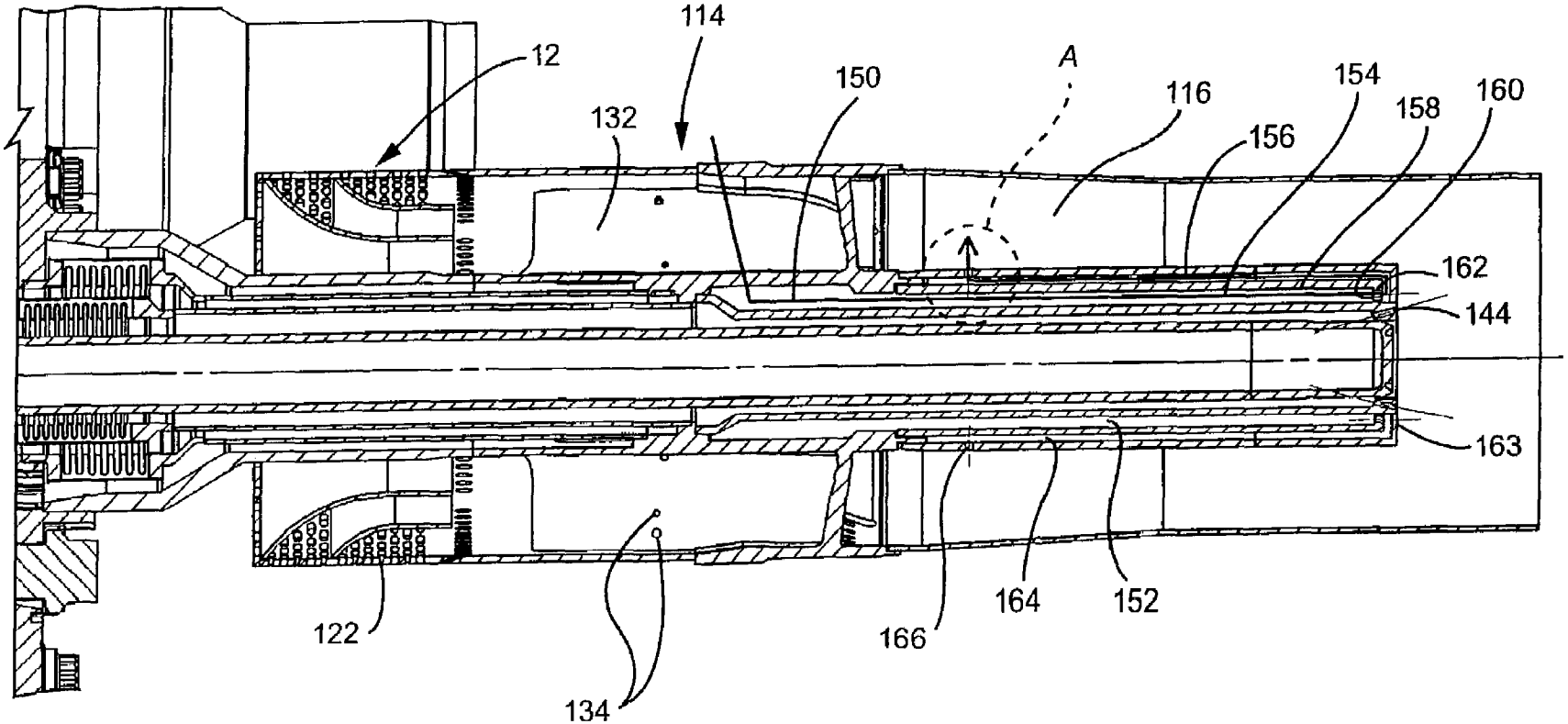
FIG. 2 is a schematic illustration, partly in cross-section, of an impingement-cooled centerbody configuration as an embodiment of the invention.
Figures 3, 4:
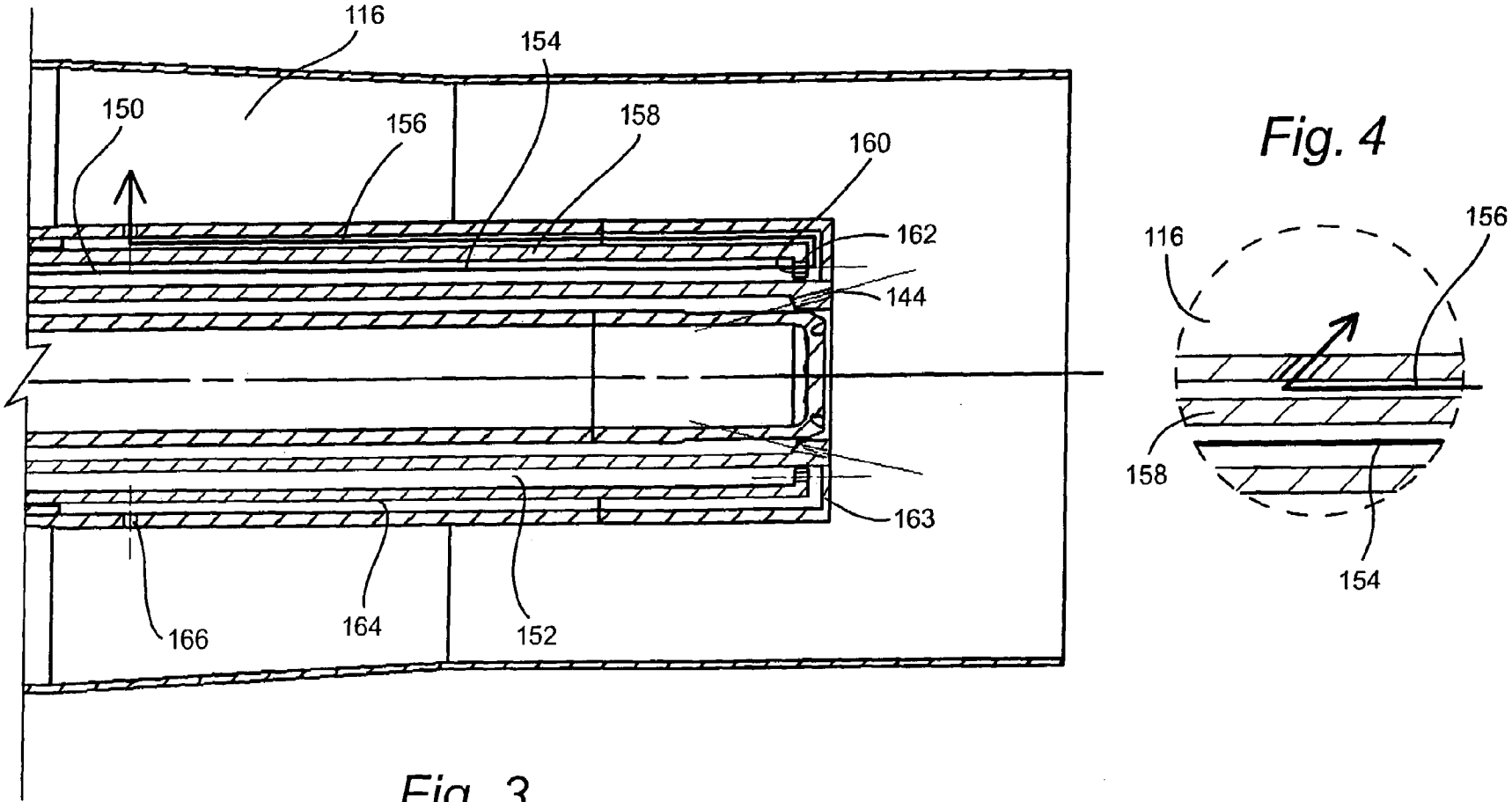
FIG. 3 is an enlarged view of the aft end of the FIG. 2 structure.
FIG. 4 is an enlarged view of an alternative configuration of the orifice for spent impingement gas in the FIG. 2 structure.

A burner assembly provided as a first embodiment of the invention is illustrated by way of example in FIGS. 2-4. For ease of explanation and understanding, components of this burner that generally correspond to components of the above-described conventional burner are designated with corresponding reference numbers, incremented by 100, but the description thereof is limited to that required to call out the differences between the inventive configuration and the conventional assembly.

In an embodiment of the invention, impingement cooling is applied to the bluff face of the premixing burner centerbody by segregating the cooling air stream 150 into a forward flowing 154 and reverse flowing stream 156 via a tubular septum 158 within the centerbody, and providing a plate structure 160 defining impingement orifices 162 at the end of the septum 158. Thus, septum 158 defines a forward flow passage 152 and a reverse flow passage 164 and, via plate 160 directs the cooling air stream as high velocity jets of air against the back side (inner surface) of the bluff face 163 of the centerbody. The spent impingement air then travels concentrically and in a reverse direction with respect to the forward flow of the cooling stream, through passage 164 towards the head-end of the premixer. The spent impingement air then discharges radially through a second set of orifices 166 into the premixing annulus 116 just downstream of the swirler 114. There the discharged air 150 mixes with the gas-air stream from the swirler 114 prior to combustion.

In the illustrated embodiment, the passages or orifices 166 for spent impingement air are illustrated as directed radially into the premixing annulus. However, these orifices may be angled in a downstream and/or circumferential direction to refresh the boundary layer and enhance flashback margin, this alternative being schematically illustrated in FIG. 4.

As will be appreciated, the provision of an impingement cooled face 163 and reverse flow configuration as proposed limits air injected into the recirculation zone to only the purge air required for the diffusion gas orifices and the gas-only insert or liquid fuel cartridge. It is further possible, with a structure provided according to the invention, to eliminate the gas-only insert altogether for gas-only design so that purge is not required. Because the spent impingement air is introduced into the gas-air stream, the spent impingement air will be premixed. While the effectiveness of premixing may be limited, as the flows combine downstream of the swirler 114, the premixing will be more substantial than that for curtain air or purge air directly entering the recirculation zone.

An advantage of configurations provided as embodiments of the invention is that flame stability is improved by reducing the dilution of the recirculation zone, thereby increasing the temperature of the recirculated burned products to provide the initiating source for flame anchoring. A further advantage is the isolation of the discharge orifice for the spent impingement air from the immediate proximity of the flame, thus reducing sensitivity to dynamic pressure fluctuations. Yet a further advantage of the disclosed structure is the use of the cooling air to help prevent flashback and flame stabilization in the region of the outer diameter of the centerbody via dilution of the mixture therein. An additional advantage is reduced sensitivity of dynamics to the selection of the purge and cooling air quantities, allowing for these quantities to be selected primarily on the basis of the cooling requirement. If sufficiently divorced from dynamic sensitivity, the centerbody cooling air may also be used to influence the emissions (primarily $NO_x$) by altering the fuel-air ratio profile at the discharge of the premixing passage. It is noted in this regard that the adoption of two orifice groups in series with a volume captured therebetween has the advantage of applying similar technology to that revealed in U.S. Pat. No. 5,211,004, the disclosure of which is incorporated herein by this references, for gas fuel nozzles and may be similarly advantageous for reduction of dynamic pressure fluctuations.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of cooling a fuel nozzle that includes an outer peripheral wall, a nozzle centerbody concentrically disposed within said outer wall, a fuel/air premixer including an air inlet, a fuel inlet, and a premixing passage defined between said outer wall and said centerbody and extending at least part circumferentially thereof; a cooling air flow passage defined within said centerbody and extending at least part circumferentially thereof; and a gas fuel flow passage defined within said centerbody and extending at least part circumferentially thereof; the method comprising:

flowing cooling air through said cooling air passage toward and impinging said cooling air against an inner surface of an end face of the centerbody; and flowing spent impingement air from a vicinity of said inner surface to and into said premixing passage defined between said nozzle centerbody and said outer wall of said fuel nozzle.

2. A method of cooling a fuel nozzle as in claim 1, wherein said impinging comprises directing said cooling air through multiple orifices to impinge said cooling air upon said end face.

3. A method of cooling a fuel nozzle as in claim 1, wherein said flowing spent impingement air comprises recirculating said spent impingement air in an upstream direction and directing spent impingement air through at least one orifice into said premixing passage.

4. A method of cooling a fuel nozzle as in claim 3, wherein said at least one orifice opens in a direction generally perpendicular to an axis of said centerbody.

5. A method of cooling a fuel nozzle as in claim 3, wherein said at least one orifice opens in a first direction that is at least one of axially and circumferentially inclined with respect to a direction perpendicular to an axis of said centerbody.

6. A method of cooling a fuel nozzle as in claim 1, wherein said fuel/air premixer comprises a swozzle assembly downstream of the air inlet, the swozzle assembly including a plurality of swozzle assembly turning vanes imparting swirl to the incoming air flowing from the air inlet, and wherein each of the swozzle assembly turning vanes comprises an internal fuel flow passage, the fuel inlet introducing fuel into the internal fuel flow passages, the fuel flow passages introducing fuel into the incoming air.

* * * * *